US008783026B2

(12) United States Patent
Floyd

(10) Patent No.: US 8,783,026 B2
(45) Date of Patent: Jul. 22, 2014

(54) GAS STRUT SEPARATION FOR STAGED ROCKET

(76) Inventor: Brian A. Floyd, Madison, AL (US)

( * ) Notice: Subject to any disclaimer, the term of this patent is extended or adjusted under 35 U.S.C. 154(b) by 243 days.

(21) Appl. No.: 13/316,477

(22) Filed: Dec. 10, 2011

(65) Prior Publication Data

US 2012/0090458 A1 Apr. 19, 2012

Related U.S. Application Data

(62) Division of application No. 12/434,388, filed on May 1, 2009, now Pat. No. 8,091,481.

(51) Int. Cl.
*F16D 31/00* (2006.01)
*F42B 15/36* (2006.01)

(52) U.S. Cl.
CPC ..... *F42B 15/36* (2013.01)
USPC ..... 60/327; 102/377; 102/378; 89/1.14

(58) Field of Classification Search
USPC ..... 60/409, 225, 327, 636, 637, 638, 632; 409/15, 31; 92/51, 134, 130 B, 117 R, 92/53; 102/377, 378; 446/212; 244/137.4, 244/104 FP; 285/2; 267/118, 124; 89/1.14
See application file for complete search history.

(56) References Cited

U.S. PATENT DOCUMENTS 2,655,232 A * 10/1953 Etherton ..... 188/287
3,112,102 A 11/1963 Messerschmitt
3,121,292 A * 2/1964 Butler et al. ..... 446/212
3,140,084 A 7/1964 Schmidt
3,160,098 A * 12/1964 Schulze et al. ..... 102/378
3,169,003 A * 2/1965 Glass ..... 244/122 AB
3,173,635 A * 3/1965 Simmons ..... 244/122 AE
3,290,037 A 12/1966 Robinson et al.
3,363,894 A 1/1968 Hill
3,393,883 A 7/1968 Smith et al.
3,514,057 A 5/1970 Biggs
3,540,683 A 11/1970 Foster
3,823,600 A * 7/1974 Wolff ..... 73/12.07
3,863,570 A 2/1975 Bixby
3,888,436 A 6/1975 Sealey
4,004,762 A 1/1977 Jenkins
4,007,894 A 2/1977 Hartel (Continued)

OTHER PUBLICATIONS

"Gas Strut Separtion Alternative for Ares". Floyd and Owens, presented at 39th Aerospace Mechanisms Symposium, May 7-9, 2008.*

(Continued)

*Primary Examiner* — Edward Look
*Assistant Examiner* — Michael Quandt
(74) *Attorney, Agent, or Firm* — Waddey & Patterson, P.C.; Lucian Wayne Beavers

(57) ABSTRACT

A staged rocket apparatus includes first and second stages connected by a releasable connector. A plurality of pressurized gas struts are connected between the first and second stages and provide a separating force urging the first and second stages apart. The gas struts are held in a telescopingly collapsed first position by the releasable connector. The separating force is maintained at a minimum value so long as the releasable connector holds the struts in their first position. When the releasable connector is disconnected the separating force increases due to gas flow through a metering passage having a progressively increasing flow area from a high pressure chamber to a low pressure chamber.

6 Claims, 14 Drawing Sheets

Schematic of the Proposed MAG Strut Design

(56) References Cited

U.S. PATENT DOCUMENTS

| | | | | | |
|---|---|---|---|---|---|
| 4,049,222 | A | * | 9/1977 | Peterson | 244/137.4 |
| 4,061,295 | A | | 12/1977 | Somm | |
| 4,062,507 | A | | 12/1977 | Felder | |
| 4,065,078 | A | | 12/1977 | Jenkins et al. | |
| 4,075,929 | A | * | 2/1978 | Peterson | 91/168 |
| 4,291,850 | A | | 9/1981 | Sharples | |
| RE30,896 | E | | 4/1982 | Jenkins et al. | |
| 4,323,224 | A | * | 4/1982 | Freitag et al. | 267/64.12 |
| 4,381,857 | A | | 5/1983 | Cook | |
| 4,399,968 | A | * | 8/1983 | Stock et al. | 244/137.4 |
| 4,474,101 | A | * | 10/1984 | Boulard et al. | 89/1.51 |
| 4,524,929 | A | | 6/1985 | Gebhard | |
| 4,529,180 | A | | 7/1985 | Hill | |
| 4,536,114 | A | | 8/1985 | Belew | |
| 4,552,324 | A | | 11/1985 | Hrusch | |
| 4,597,548 | A | | 7/1986 | Bergloff et al. | |
| 4,645,143 | A | | 2/1987 | Coffy | |
| 4,648,570 | A | | 3/1987 | Abdelmaseh et al. | |
| 4,685,377 | A | * | 8/1987 | Mace et al. | 89/1.54 |
| 4,729,529 | A | | 3/1988 | Hrusch | |
| 4,787,486 | A | | 11/1988 | Hrusch et al. | |
| 4,856,762 | A | | 8/1989 | Selzer | |
| 4,871,149 | A | * | 10/1989 | Dony et al. | 267/64.12 |
| 4,886,248 | A | | 12/1989 | Delhaye et al. | |
| 4,974,794 | A | | 12/1990 | Aubry et al. | |
| 5,085,382 | A | | 2/1992 | Finkenbeiner | |
| 5,158,267 | A | | 10/1992 | Pascal | |
| 5,218,165 | A | | 6/1993 | Cornelius et al. | |
| 5,244,170 | A | | 9/1993 | Shekher | |
| 5,269,489 | A | | 12/1993 | West et al. | |
| 5,806,794 | A | | 9/1998 | Hrusch et al. | |
| 6,273,398 | B2 | | 8/2001 | Lloyd | |
| 6,289,818 | B1 | * | 9/2001 | Mueller et al. | 102/377 |
| 6,336,610 | B1 | | 1/2002 | Wode | |
| 6,408,763 | B1 | * | 6/2002 | Hurtta et al. | 102/404 |
| 6,481,669 | B1 | * | 11/2002 | Griffin | 244/137.4 |
| 6,758,142 | B1 | | 7/2004 | Seaquist | |
| 6,834,841 | B2 | | 12/2004 | Osterberg | |
| 6,920,966 | B2 | | 7/2005 | Buchele et al. | |
| 7,093,806 | B2 | | 8/2006 | Osterberg | |
| 7,193,530 | B2 | | 3/2007 | Nance | |
| 7,274,309 | B2 | | 9/2007 | Nance | |
| 7,274,310 | B1 | | 9/2007 | Nance | |
| 7,530,613 | B2 | * | 5/2009 | Kim et al. | 294/82.24 |

OTHER PUBLICATIONS

Figs. 22 and 23, and paragraphs [0004]-[0006] of the present application are admitted to be prior art.

* cited by examiner

Ares 1

Interstage showing BDMs and Struts

Ares I Separation Clearance using Gas Strut System

| | Residual thrust (kN) | Payload gained (kg) |
|---|---|---|
| pt 1 | 445 | 105.8 |
| pt 2 | 356 | 90.1 |
| pt 3 | 267 | 63.9 |
| pt 4 | 222 | 34.6 |
| pt 5 | 200 | 18.3 |
| pt 6 | 178* | 0.0* |
| pt 7 | 156 | -23.0 |
| *Thrust used for baseline | | |

Payload Delta from Baseline vs. Separation Thrust

Momentum Transfer Effects for a Separation at 356 kN SRB Thrust

Schematic of the Proposed MAG Strut Design

Average Thrust and Oscillatory Thrust Test Data for 5 Segment SRM

Strut Rendering (Collapsed)M

Strut Rendering (Extended)

Exposed Hole Area for Two Candidate Hole-Patterns

Ullage Gas Collapse Mitigation Proposals

Force Rate of Change Plot

Strut Force as a Function of Stroke

Force as a Function of Time

MAG Strut Performance Development Test Set-up

Strut Fitting Aft Skirt Mounted Spike Fitting

System demonstration test set up

GAS STRUT SEPARATION FOR STAGED ROCKET

The U.S. Government has a paid-up license in this invention and the right in limited circumstances to require the patent owner to license others on reasonable terms as provided for by the terms of Contract No. NNM05AB50C awarded by the National Aeronautics and Space Administration.

BACKGROUND OF THE INVENTION

1. Field of the Invention

The present invention relates generally to the field of gas strut technology and more particularly, to gas struts usable for providing a separating force between two stages of a staged rocket apparatus.

2. Description of the Prior Art

FIGS. 22 and 23 schematically illustrate two prior art systems utilizing gas struts to provide a separating force between stages of a staged rocket.

The system in FIG. 22 is a schematic representation of a prior art tank-based gas strut system The system of FIG. 22 relies on a tank containing gas and a distribution system to an array of gas struts. This system is used to produce the separation force for the Delta IV rocket. In this system, 16 short stroke struts push the stages apart. Two tanks are used with ordinance initiated valves to fill the struts through a distribution system. The tanks are very high pressure to reduce their size and make the gas flow fast trough the distributions system. Half of the struts are filled from one tank and the other half are filled by the other tank. The two systems in parallel provide assured separation because there are two independent separate systems onboard. It has the drawback that two systems, each capable of providing the separation force, must be present on the vehicle. This adds weight and cost. The struts have solid rods and have little ability to stabilize the separation by counteracting disturbance forces acting during separation. The Falcon 9 separation struts are similar to the Delta IV struts except there are only 3 struts and the tank is used for other systems as well as the struts. To gain separation reliability, the Falcon 9 system seeks to minimize failure points where the Delta IV system seeks to provide redundancy.

FIG. 23 is a schematic illustration of a prior art gas generator based strut system. This system uses independent gas struts with a gas generator attached to each strut. This system has the advantage that a failure in one part of the system cannot propagate to another part of the system. It has the disadvantage that gas generators burn at a constant rate meaning that the gas generator will not be able to keep up with needed gas at the end of the strut stroke. The initial force will be very high causing a sudden acceleration to the vehicle which is undesirable for tanked liquid propellants. Elaborate profiled grain designs can mitigate this effect to some extent. Mitigation can also be done by over sizing the gas generators and providing pressure relief for the initial part of the stroke. A gas generator strut arrangement was used on X43. In this system, 3 struts were used to drive the Pegasus booster back from the X43.

Along with gas strut systems such as those of FIGS. 22 and 23, systems based on booster deceleration motors (BDM's) have also been utilized in the past for stage separation to push the stages apart.

SUMMARY OF THE INVENTION

The present invention provides an improved system for separating the stages of a staged rocket apparatus utilizing gas struts. A first and second stage of the rocket apparatus are connected by a releasable connector. A plurality of pressurized gas struts are connected between the first and second stages and provide a separating force pushing the first and second stages apart. The struts are held in a telescopingly collapsed first position by the releasable connector which connects the first and second stages. Each strut includes a high pressure gas chamber, a low pressure gas chamber, a metering passage defined between the high pressure gas chamber and the low pressure gas chamber, and a passage seal closing the metering passage when the strut is in the first position, so that the separating force is maintained at a minimum value so long as the releasable connector holds the struts in their first position. The metering passage provides a progressively increasing flow area from the high pressure chamber to the low pressure chamber as each strut moves toward a telescopingly expanded position, so that the separating force increases after the releasable connector is disconnected. The unique gas strut construction of the present invention allows a controlled and variable application of separating force between the stages.

In another aspect of the invention a staged rocket apparatus includes a first and second stage, and a gas strut connected between the first and second stages. The gas strut includes an outer strut housing including a bore defined therein. A metering rod is attached to the housing and extends axially into the bore. An inner strut rod includes a piston end slideably received in the bore, the piston end includes an exterior end surface communicated with the bore. The piston end also includes an axial opening through which the metering rod is slideably received. A high pressure chamber is defined within the inner strut rod. A low pressure chamber is defined as part of the housing bore surrounding the metering rod and communicated with the exterior end surface of the piston end of the piston rod. A variable area metering passage is defined by the metering rod and the axial opening of the piston end. The passage is closed when the strut rod is in a first telescopingly collapsed position relative to the strut housing. The passage has an increasing passage flow area as the strut rod telescopes outwardly relative to the strut housing.

In another aspect of the invention a method of providing a separating force includes steps of:

(a) providing a gas strut including first and second telescoping members, a high pressure gas chamber, a low pressure gas chamber, a metering passage between the chambers, and a metering passage seal;

(b) holding the telescoping members in a telescopingly collapsed first position wherein the metering passage seal prevents gas flow through the metering passage, and providing a first separating force between the telescoping members in the first position;

(c) releasing the telescoping members and allowing the telescoping members to move from the first position toward a telescopingly expanded second position; and (d) as the telescoping members move from the first position toward the second position, flowing pressurized gas from the high pressure chamber to the low pressure gas chamber via the metering passage and increasing the separating force.

Numerous objects, features and advantages of the present invention will be readily apparent to those skilled in the art upon a reading of the following disclosure when taken in conjunction with the accompanying drawings.

DETAILED DESCRIPTION OF THE INVENTION

Figure 1:
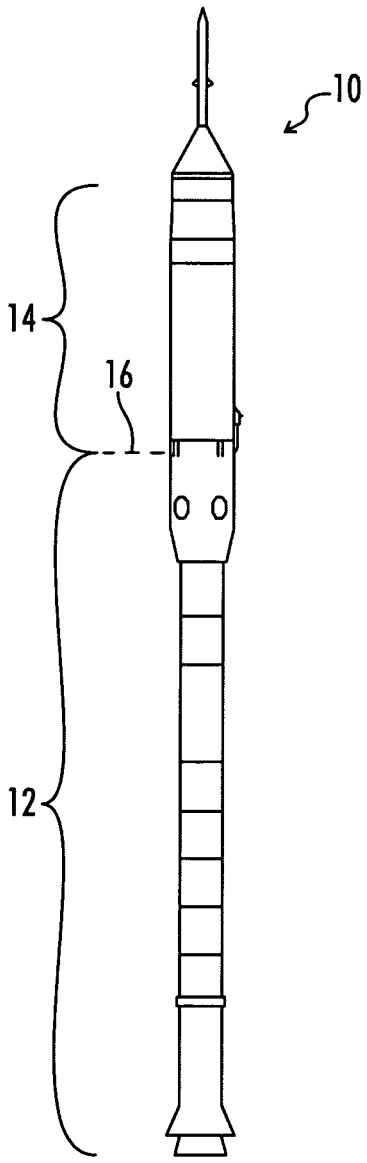
FIG. 1 is a schematic illustration of the Ares I rocket configuration. Much of the following disclosure describes a proposed use of the invention in the context of the Ares I rocket currently under development by NASA.

FIG. 1 shows an elevation view of a staged rocket apparatus designated by the numeral 10. The rocket apparatus shown in FIG. 1 is the proposed Ares I rocket. The rocket 10 includes a first stage 12 and a second stage 14. As is well known to those skilled in the art the stages 12 and 14 are connected by a breakable or frangible separation joint 16 schematically illustrated in FIG. 20. The frangible separation joint 16 may be described as a releasable connector 16 connecting the first and second stages 12 and 14. The joint 16 is severed by pyrotechnics controlled by ordinance fire units 18 schematically illustrated in FIG. 20.

Figure 20:
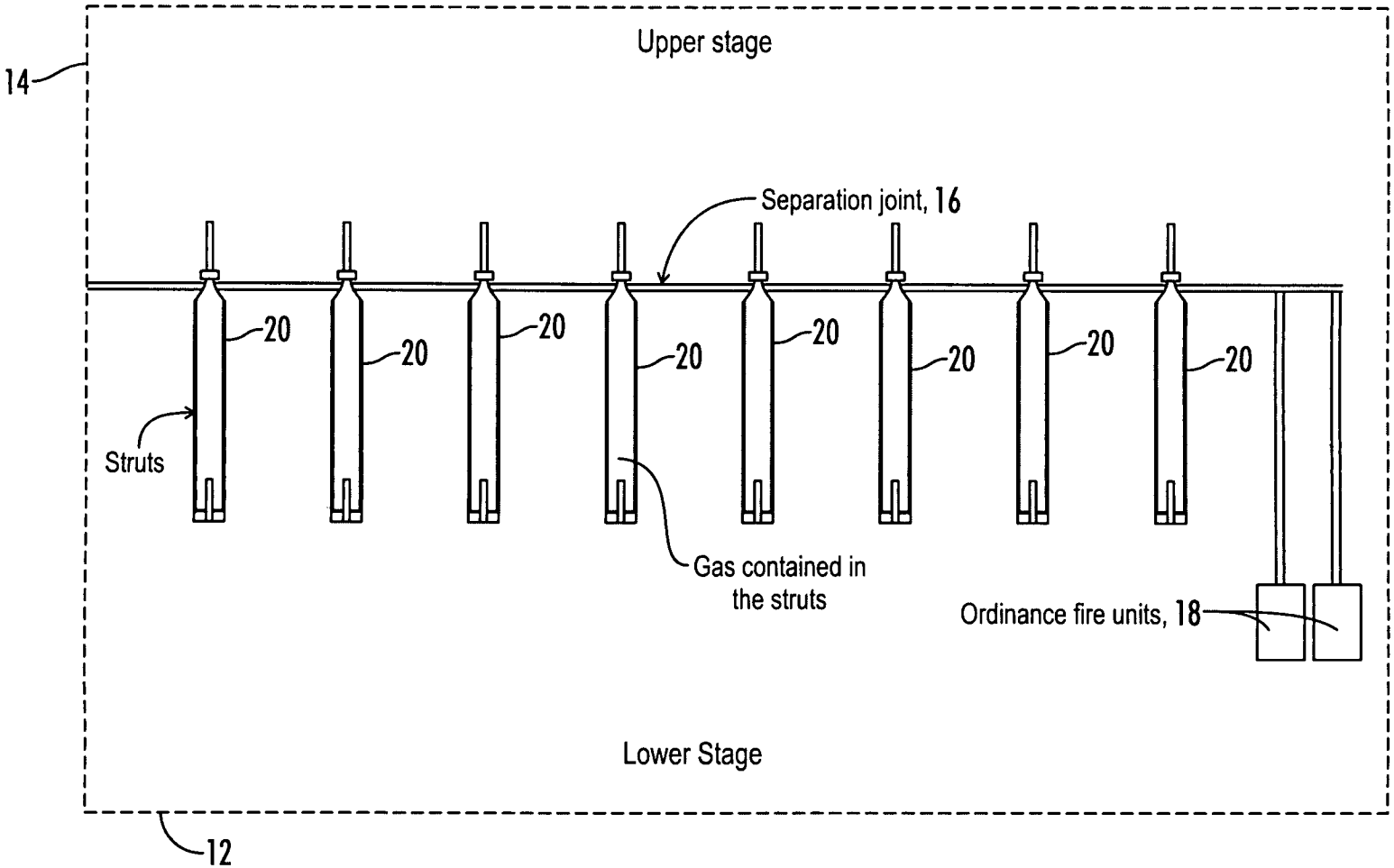
FIG. 20 is a schematic illustration of the gas strut separator system of the present invention.

As further illustrated in FIG. 20, eight pressurized gas struts 20 also connect the first and second stages 12 and 14 to provide a separating force urging the first and second stages 12 and 14 apart. The gas struts 20 are also sometimes referred to herein as Metering Adiabatic Gas Struts (MAG Struts)

Figure 7:
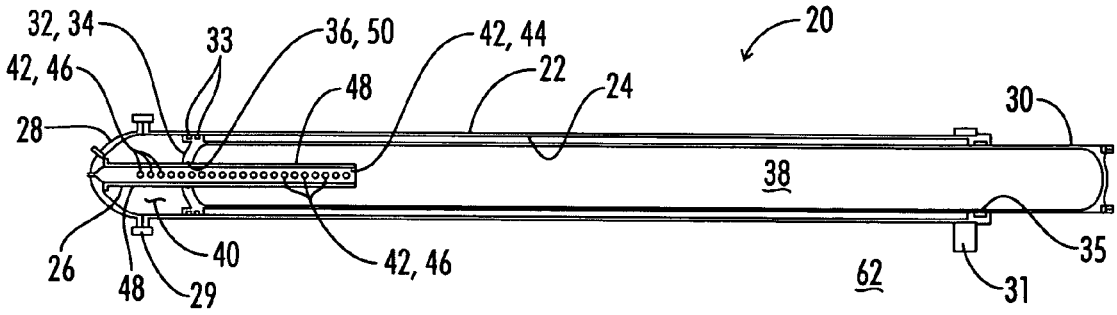
FIG. 7 is a schematic sectioned elevation view of the gas strut of the present invention.

FIG. 7 is a schematic sectioned view of one of the gas struts 20. The gas strut 20 includes an outer strut housing 22 having a polished cylindrical bore 24 defined therein. A metering rod 26 is attached to a lower end 28 of the housing 22 and extends axially and concentrically within the bore 24 of housing 22.

The gas strut 20 further includes an inner strut rod 30 which includes a piston end 32 slideably received in the bore 24. The piston end 32 includes an exterior end surface 34 which is communicated with the bore 24. Piston end 32 also includes an axial opening 36 through which the metering rod 26 is slideably received. A guide bracket 29 extends from strut housing 22 near its lower end, and a load collar 31 extends from strut housing 22 near its upper end. Guide bracket 29 and load collar 31 are used to attach the outer strut housing 22 to the first stage 12.

Piston end 32 carries seals 33. A slide ring 35 reduces friction between the upper end of outer strut housing 22 and the outside diameter of inner strut rod 30. Slide ring 35 is preferably a Teflon slide.

A high pressure chamber 38 is defined within the inner strut rod 30. A low pressure chamber 40 is defined as part of the housing bore 24 surrounding the metering rod 26 and communicated with the exterior end surface 34 of the piston end 32 of the strut rod 30.

A variable area metering passage 42 is defined by the metering rod 26 and the axial opening 36 of the piston end 32. In the embodiment of FIG. 7, the metering passage 42 comprises a longitudinal passage 44 defined in the metering rod 26 and a series of radial ports 46 communicating the longitudinal passage 44 with an exterior 48 of the metering rod 26.

The axial opening 36 carries an annular metering rod seal 50 which slideably seals against the outer cylindrical surface 48 of metering rod 26.

In a first collapsed position (see FIG. 9) of the gas strut 20, the strut rod 30 is moved further inward relative to housing 22 as compared to the intermediate position shown in FIG. 7, so that in the first collapsed position the metering rod seal 50 is located below the lowermost one of the radial ports 46 so that in that initial collapsed position the metering rod seal 50 prevents any flow of gas through the metering passage 42. When the strut rod is in its telescopingly collapsed position relative to the strut housing 22, the high pressure chamber 38 has a volume greater than the volume of the low pressure chamber 40.

As the strut rod 30 moves outwardly from its first collapsed position toward a second extended position (see FIG. 10) it moves through a series of intermediate positions such as that illustrated in FIG. 7, so that as the strut rod 30 telescopes outwardly relative to the strut housing 22 an increasing number of the radial ports 46 are communicated with the low pressure chamber 40 so that the metering passage 40 has an increasing passage flow area as the strut rod 30 telescopes outwardly relative to the strut housing 22.

Figure 21:
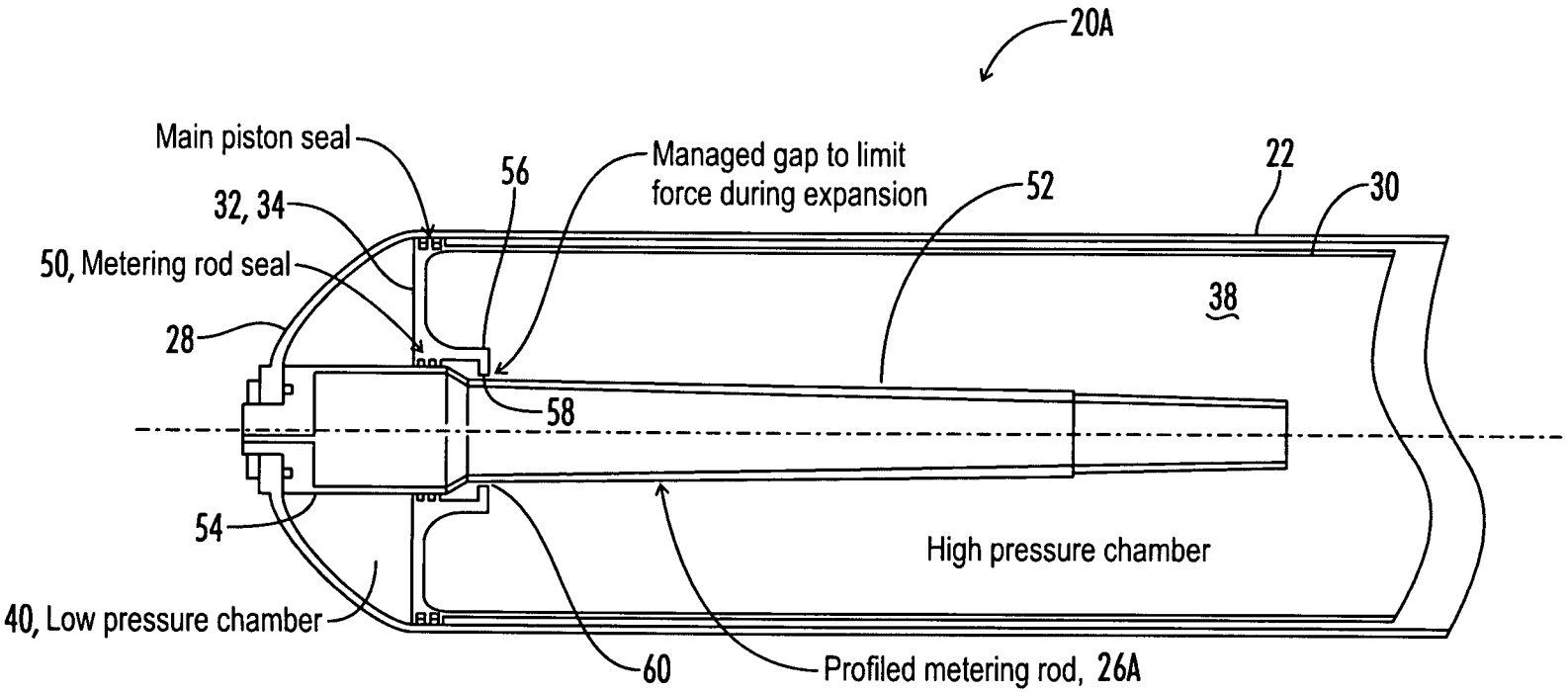
FIG. 21 is a cross-sectioned view of an alternative embodiment of the separator of FIG. 7 utilizing a profiled metering rod rather than a metering rod containing a plurality of radial holes.
Figure 22:
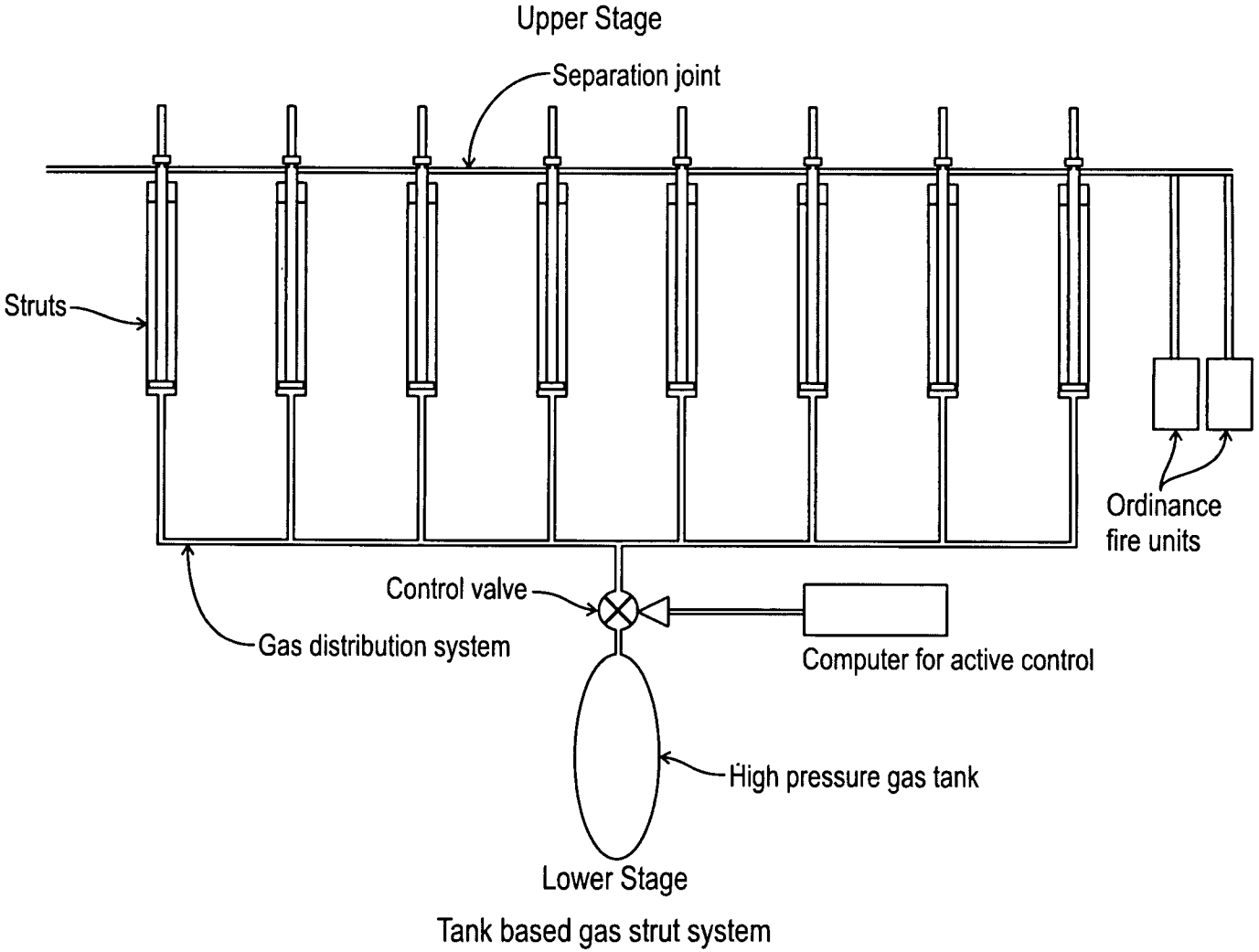
FIG. 22 (PRIOR ART)
FIG. 22 is a schematic illustration of a prior art gas strut separator system which is tank-based.
Figure 23:
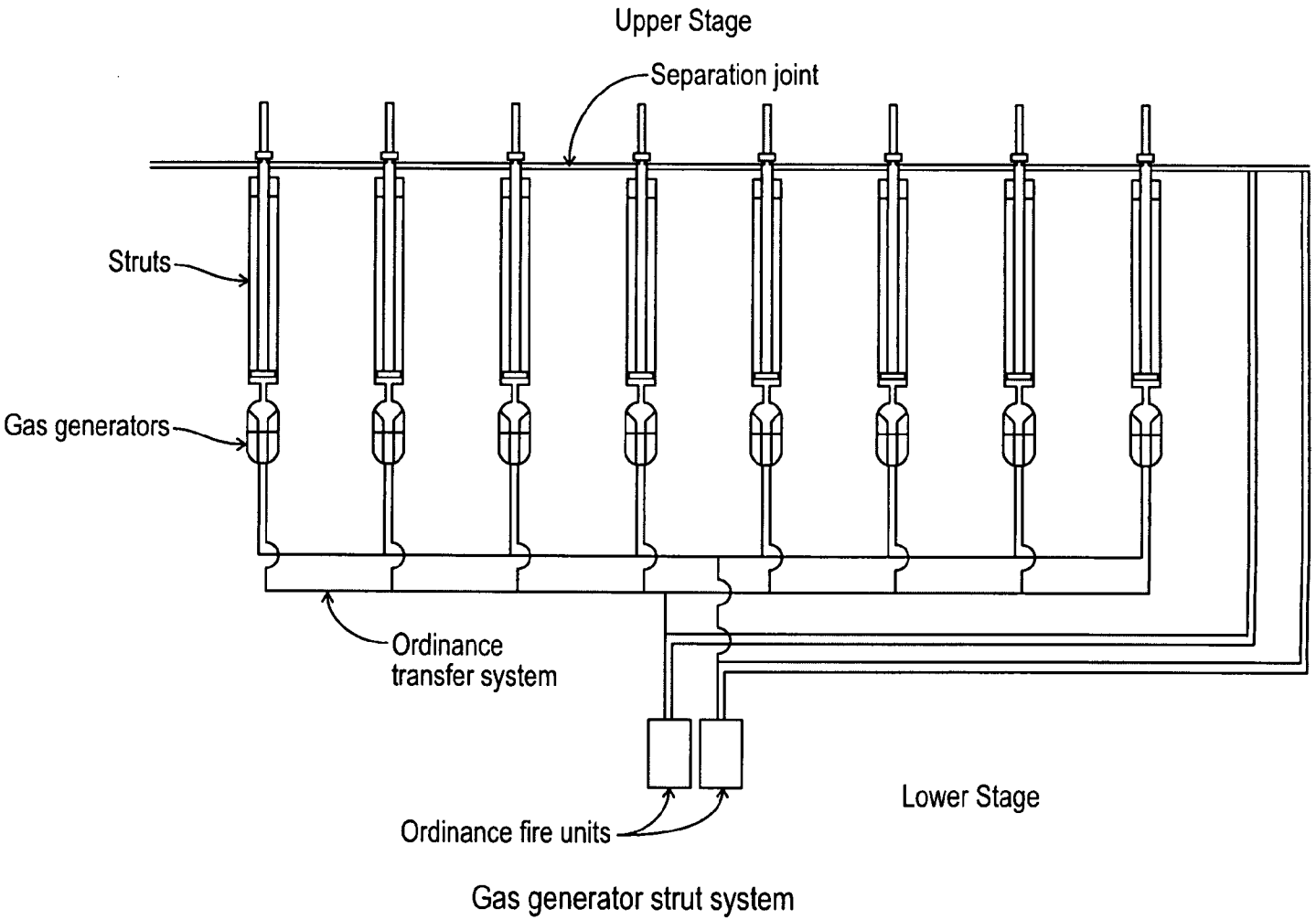
FIG. 23 (PRIOR ART)
FIG. 23 is a schematic illustration of a prior art gas strut separator system utilizing a gas generator.

In an alternative embodiment of the invention as schematically illustrated in FIG. 21, wherein like components have like numbers as those of FIG. 7, and wherein modified components carry a suffix A, a metering rod 26A has a tapered outer surface 52 which may be more generally described as a profiled outer surface 52. The profiled surface 52 may be a straight taper as shown, or a curved taper, or a stepped taper, or any other suitable shape.

When the gas strut 20A of FIG. 1 is in its first collapsed position as shown in FIG. 21, the metering rod seal 50 seals against an enlarged diameter portion 54 of metering rod 26A.

The piston end 32 has an axial inward protruding part 56 having a metering opening 58 so that an annular gap 60 is defined between the piston end 32 and the tapered surface 52. The annular gap 60 which may also be referred to as an annular passage 60 will increase in size as the strut rod 30 strokes outwardly from its first collapsed position of FIG. 21, due to the tapered and reducing outer diameter 52 of the metering rod 54.

The rate of increase in the passage flow area defined by annular passage 60 between the high pressure gas chamber 38 and the low pressure gas chamber 40 can be controlled by the design of the profiled outer surface 52.

Returning now to FIG. 7, the high pressure gas chamber 38 is initially filled with a high pressure gas at a pressure higher than a pressure present in the low pressure gas chamber 40. As further described below, the pressure in the high pressure gas chamber 38 will provide an initial strut force urging the strut rod 30 to telescope outward from the strut housing 22, which initial strut force equals a differential pressure between the high pressure chamber 38 and an ambient pressure 62 exterior of the strut housing 22 acting on a differential area equal to the cross-sectional area of the axial opening 36 through the piston end 32. As further explained below, the initial strut force urging the strut rod 30 to telescope outwardly may also be increased due to a lower pressure present in the low pressure chamber 40 if that low pressure also exceeds the ambient exterior pressure 62. And in a further embodiment, the low pressure chamber 40 may contain a pressure equal to the ambient pressure in which case the initial strut force would be due exclusively from the high pressure gas in high pressure chamber 38.

As the strut rod 30 telescopes outward from its initial fully collapsed position wherein there is no communication through the variable area metering passage 42, toward its telescopingly extended position, the ever increasing flow area of variable area metering passage 42 allows high pressure gas from high pressure chamber 38 to flow through passage 42 into low pressure chamber 40 thus increasing the pressure in low pressure chamber 40. That pressure in low pressure chamber 40 acts against the piston end 32 upon a differential area equal to the difference between the cross-sectional area of bore 24 minus the cross-sectional area of the axial opening 36. Thus as high pressure gas flows into the low pressure chamber 40 increasing the pressure therein, the total force acting upon the strut rod 30 to telescope the same outwardly increases. Because the cross-sectional area of the axial opening 36 across which the gas in high pressure chamber 38 acts is less than the annular area defined by the difference between the bore 24 and axial bore 36 upon which gas in the low pressure chamber 40 acts, the flow of pressurized gas from the high pressure chamber 38 to the low pressure chamber 40 results in an increase in the total force acting to push the strut rod 30 outwardly relative to the strut housing 22.

The high pressure chamber 38 is preferably pre-pressurized and is self-contained. It need not be connected to a source of pressurized gas during operation, and thus no external pressure supply to the high pressure chamber 38 is required during operation of the strut 20.

Thus a plurality of pressurized gas struts 30 are connected between the first and second stages 12 and 14 providing a separating force urging the first and second stages 12 and 14 apart. The struts 20 are held in a telescopingly collapsed first position by the releasable connector 16. Each strut includes its high pressure gas chamber 38, its low pressure gas chamber 40, its metering passage 42, and its passage seal 50 closing the metering passage 42 when the strut 20 is in its first position so that the separating force is maintained at a minimum value so long as the releasable connector 16 holds the struts 20 in their first position. When the releasable connector 16 is disconnected or severed, the metering passage 42 provides a progressively increasing flow area from the high pressure chamber 38 to the low pressure chamber 40 as each strut 20 moves toward a telescopingly expanded position, so that the separating force increases after the releasable connector 16 is disconnected.

The method of providing a separating force utilizing the strut 20 includes the following steps.

The gas strut 20 is provided including first and second telescoping members 22 and 30, the high pressure gas chamber 38, the low pressure gas chamber 40, the metering passage 42 between the chambers, and the metering passage seal 50.

The telescoping members 22 and 30 are held in a telescopingly collapsed first position wherein the metering passage seal 50 prevents gas flow through the metering passage 42, thereby providing a first separating force between the telescoping members 22 and 30 in the first position.

The telescoping members 22 and 30 are released by disconnecting the releasable connection 16 between the first and second stages 12 and 14 of the staged rocket 10, thereby allowing the telescoping members 22 and 30 to move from their first position toward a telescopingly expanded second position.

As the telescoping members 22 and 30 move from the first position toward the second position, pressurized gas flows from the high pressure gas chamber 38 to the low pressure gas chamber 40 via the metering passage 42 thus increasing the separating force acting between the first and second telescoping members 22 and 30.

An Exemplary Illustration of the Invention with the Proposed Ares I Rocket

The following example presents a design alternative and the rationale for a stage separation system based on Metering Adiabatic Gas Struts (MAG Struts) for the Ares 1 launch vehicle. The MAG Strut separation system was proposed as an alternative to the current Ares 1 separation system, which relies on small solid rocket motors to provide the main separation force. This example presents a conceptual design of a strut system and compares the strut system design to the Ares I BDM based system as configured in its preliminary design state. Needed development testing and programmatic considerations are also discussed.

Introduction

Gas struts show promise as an efficient way to provide the separation force for launch vehicle staging. Strut systems are currently in use on a number of vehicles, but so far all have been unmanned. Several factors make the MAG Strut system unique. The struts are entirely self-contained. They are themselves pressure vessels, which are pre-charged with gas prior to launch. They require no additional actuation, but simply act as springs when the physical connection between stages is severed. Due to the mass properties of the separating stages, this system provides excellent nozzle clearance during fly-out in off-nominal conditions. Consequently, safety and mission success objectives are enhanced. Since the struts are light weight relative to other separation systems capable of applying the same force, the separation timing can be adjusted to separate earlier during the assent trajectory, increasing payload lift capability. The proposed struts apply the separation force smoothly during release in order to minimize disturbance of the Upper Stage propellant and reduce the buckling loads applied to the upper stage aft skirt. The trade study also predicts significantly lower life-cycle-cost. Since the MAG Strut system is not in flight operation on any launch vehicle, development testing and system-qualification introduce some risk into the Ares program, which is a barrier to adopting the system.

Background

The Ares I launch vehicle will lift the Orion crew vehicle to low-earth orbit for manned missions to the International Space Station and to the moon. Ares I consists of two stages. The first stage is a modified Space Shuttle Solid Rocket Booster (SRB) with 5 solid motor segments instead of the 4 segments currently used for shuttle. The Ares I upper stage is a LOx/LH2 stage powered by a J-2X engine. The stages are connected by a cylindrical interstage and a conical frustum. The J-2X engine is housed in the compartment formed by the interstage and frustum.

In the current flight trajectory baseline, the first stage ascent phase ends when the first stage reaches 178 kN of residual thrust. Eight Booster Deceleration Motors (BDMs) fire to push the first stage aft. Eight Ullage Settling Motors (USMs) thrust forward to maintain positive acceleration on the upper stage. Once the USMs and BDMs are ignited, a pyrotechnic joint at the forward end of the interstage initiates and the vehicle begins to separate. FIG. 1 shows the Ares I configuration with the BDMs mounted on the interstage. In the most recent configuration, they are relocated to the aft skirt of the first stage. The J-2X nozzle exit plane is 7.1 meters aft of the separation plane. With the current arrangement separation system, it takes approximately 1.7 seconds for the nozzle to pass the forward end of the interstage.

Nozzle Clearance During Fly-Out Considerations

Many factors affect the amount of radial clearance between the engine nozzle and the interstage wall during the fly-out. The most significant factor contributing to clearance issues for BDM separation is asymmetric plume impingement force on the first stage that can occur if one motor fails to fire. Secondly, since the first stage has 178 kN of residual thrust at the time of separation, significant pitching and yawing loads may be imposed on the stack before separation and on the first stage after separation due to thrust vector pointing uncertainties. With one BDM out, a worst-on-worst analysis of the separation shows contact between the interstage and the engine nozzle during fly-out. Monte Carlo analysis of this scenario shows that nozzle clearance can only be demonstrated to a 2.5 sigma level.

Figure 2:
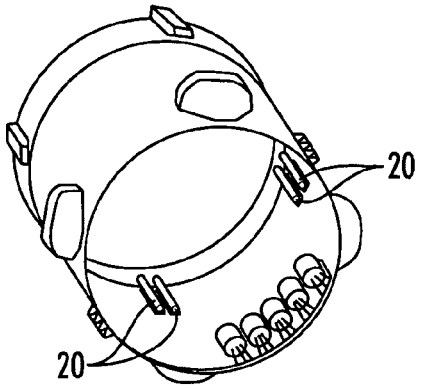
FIG. 2 is a perspective view of the interstage of the Ares I rocket showing both booster deceleration motors and the proposed location of gas struts.

The proposed MAG Strut system uses eight gas-charged struts mounted inside the interstage to force the two stages apart. The struts essentially act as alignment guides during separation. FIG. 2 shows the relative position of the struts on the interstage to the USMs and the BDMs they will replace.

Figure 3:
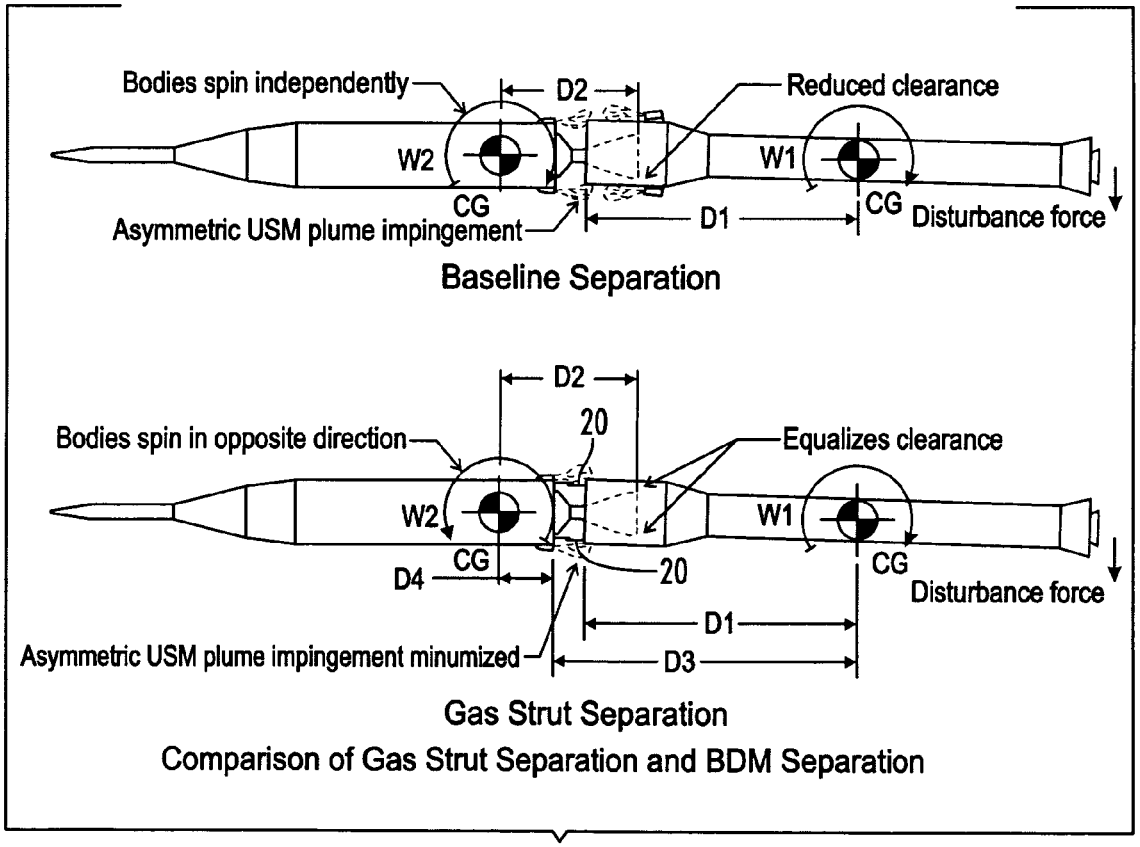
FIG. 3 is a schematic illustration comparing stage separation with gas struts in the lower portion of the figure and with booster deceleration motors in the upper portion of the figure.

Although the struts extend above the separation plane, they provide superior clearance, even with one strut out. The primary reason for this superior performance is that the mass-moment-of-inertia of the Ares I upper stage/crew vehicle is approximately ½ that of the mass-moment-of-inertia of the expended first stage, while the distance from the upper stage/crew vehicle center-of-gravity to the J2 nozzle exit plane is approximately ½ the distance of the center-of-gravity of the first stage to the separation plane. FIG. 3 shows the relative positions of the centers-of-gravity of the separated stages to the nozzle exit plane and first stage separation plane. With a strut system, any disturbance force, regardless of its origin, is compensated for by the struts, forcing the separated stages to rotate in the opposite directions. The rate-of-rotation, W, induced on the two bodies in always close to 2/1 with the upper stage/crew vehicle rotating at twice the rate of that of the first stage. The rate of rotation of each body is small with the gas strut system. Distance D3 is considerably larger than distance D4 so some of the disturbance force coming from the first stage results in translating the upper stage in the same direction the interstage is moving. This translation effect, though beneficial, is not as significant as the rotational compensation.

Figure 4:
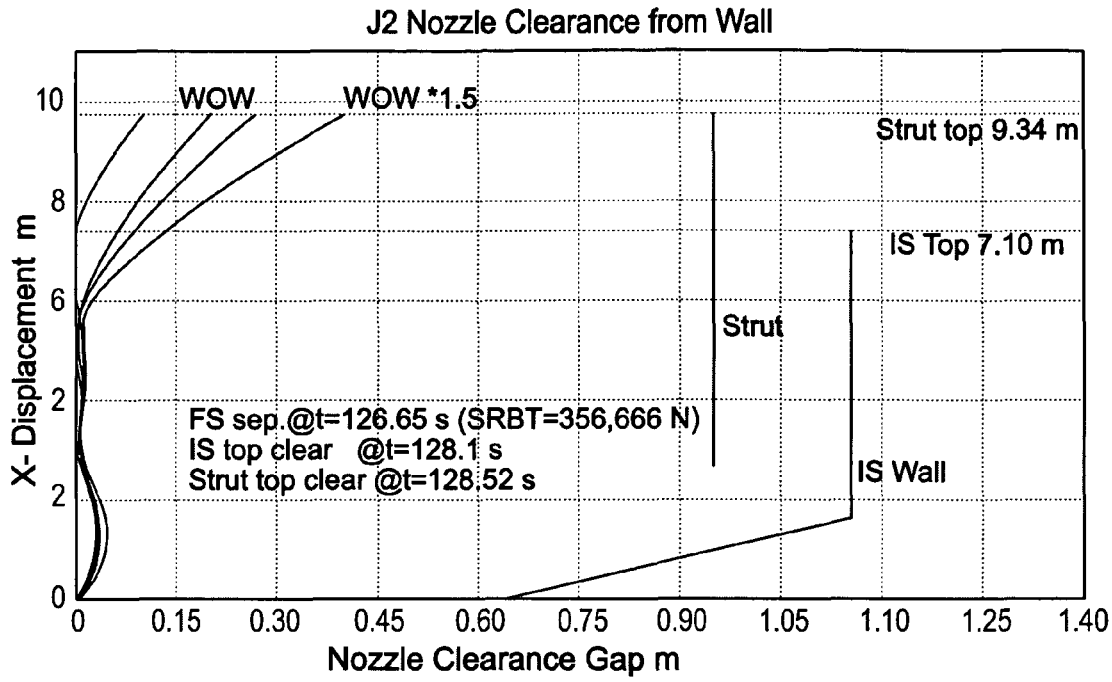
FIG. 4 is a graphic illustration showing separation clearances for the Ares I using the gas strut system.

FIG. 4 shows the preliminary clearance results for the Ares I upper stage engine nozzle with one strut out. The WOW*1.5 curve represents a worst-on-worst assessment of the radial clearance with a margin of 50% added to account for unknowns in the analysis. Even in this conservative case, the nozzle clears the extended end of the strut by 45.7 cm. The dash lines represent WOW case clearances for different failed struts with different disturbance scenarios. Two seals must fail on the same strut to result in a 100% pressure loss. Based on the analytical results, 1 strut failure cannot result in the loss of an Ares I mission due to nozzle contact. Consequently, the MAG Strut system is inherently 2-fault tolerant.

Plume Heating on Upper Stage

At the Ares I System Definition Review (SDR), the vehicle was configured with BDMs mounted near the aft end of the interstage in four pods containing two motors each. The USMs were mounted on the upper stage aft skirt, also in four pods of two at the same angular positions around the cylinder. One problem with this configuration is the interaction of the USM and BDM plumes. Even though the nozzle exit planes were separated by over 4.5 meters axially, extreme heating was predicted in the upper stage engine compartment during separation because the BDM plumes deflect the USM plumes into the interior of the interstage. Also, debris generated by the separation pyrotechnics will likely be propelled into the engine compartment by the interacting plumes. The use of gas struts eliminates these debris and heating concerns. Relocating the BDMs to the first stage aft skirt would resolve this issue.

Payload-to-Orbit Benefits

Gas strut separation produces a significant increase in payload-to-orbit capability. This gain is a result of reduced aerodynamic drag, momentum transfer between the stages, and ascent trajectory optimization.

The interstage-mounted BDM pods are the largest protrusions from the nominal outer moldline (OML) of the vehicle. As such they account for a total of a 110 to 120 kilogram payload penalty due to aerodynamic drag. The proximity of the BDMs to transition from the conical to cylindrical is a major factor in the high drag. Locating the struts inside the interstage eliminates all aerodynamic drag effects.

Figure 5:
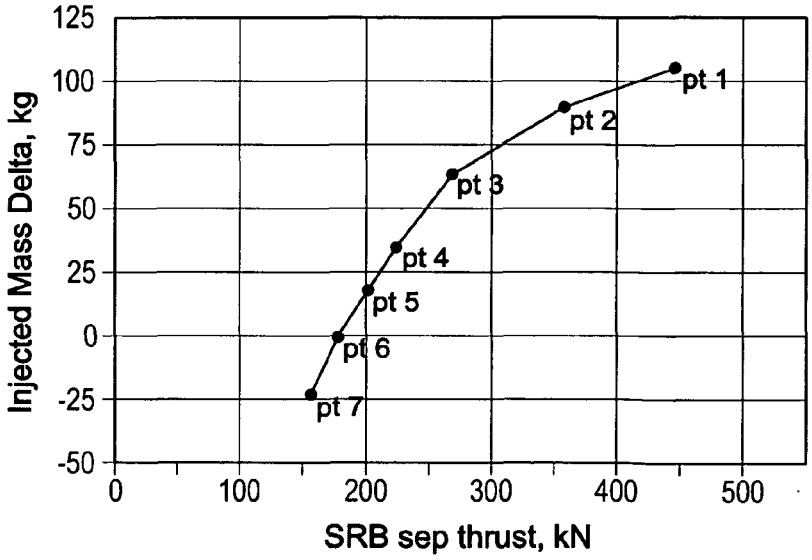
FIG. 5 is a graphic illustration indicating the amount of payload that can be gained for the Ares I utilizing the proposed gas strut technology as compared to the baseline flight profile using BDM technology.

For the baseline trajectory, the amount of residual first stage thrust at separation is limited by the capability of the BDMs. For an 8 BDM configuration with one motor out, separation must wait until first stage thrust drops to 178 kN. Because the struts have a better weight to performance ratio than BDMs, the trajectory can be optimized to improve performance. FIG. 5 indicates the amount of payload that can be gained relative to the baseline flight profile. The steeper section of the curve indicates a significant payload improvement, but the strut system mass (including additional upper stage structural mass) begins to offset the benefit as residual thrust increases. Separation at 356 kN of residual first stage thrust is thought to be optimum for Ares I. This results in approximately 90 kilograms. additional payload due to improved trajectory performance.

During separation with gas struts, the first stage thrust continues to act on the upper stage until the end of the stroke.

Figure 6:
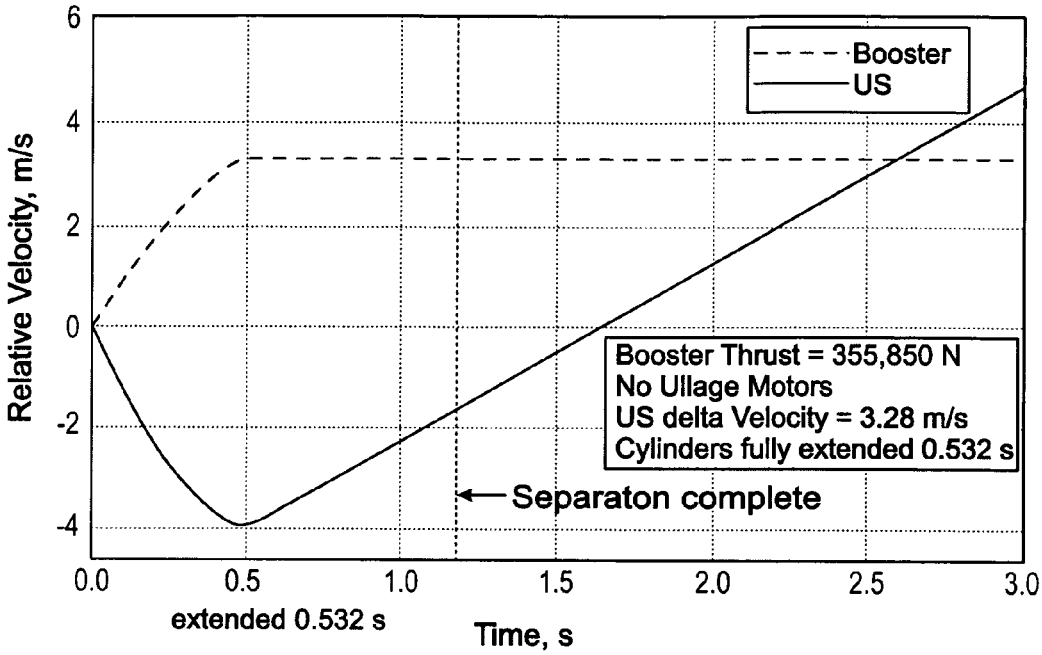
FIG. 6 is a graphic illustration showing the relative velocity gained by the upper stage of the Ares I for stage separation at 356 kN of solid rocket booster thrust.

Initial calculations show that this momentum transfer adds payload performance at a rate of 8.93 kilograms for every meter per second of ΔV. Preliminary strut designs result in an increase in upper stage ΔV of 3 to 3.7 meters per second. This amounts to 27 to 33 kilograms of additional payload. FIG. 6 shows the relative velocity gained by the upper stage for a separation with 356 kN of residual thrust.

The mass of the struts and upper stage fittings for a 356 kN thrust separation are about half that of a BDM system that separates at 178 kN of residual thrust; however, because more of the mass remains with the upper stage, no additional payload advantage from the change in system mass is realized.

TABLE 1

| Approximate Payload Benefit | |
|---|---|
| Reduced Drag | 110 kg |
| Earlier Separation | 90 kg |
| Momentum Transfer | 27 kg |
| Mass Delta Benefit | 0 kg |
| Total Payload Benefit | 227 kg |

Cost Considerations

The projected unit cost for each BDM is approximately $200,000.00. There are many reasons for this high cost. One of the most risky processes of solid rocket motor manufacturing is the casting and curing of the solid rocket propellant. The process is very hazardous and requires extensive risk mitigation to prevent inadvertent propellant ignition. The risk mitigation techniques are well known, and accidents are now rare, but the process is expensive. Additionally, post casting inspection sometimes reveals defects in the cast propellant. If a defect is found, most often the motor is discarded.

Per unit cost for gas struts should be significantly less than BDMs, since there is no hazardous material to procure and handle. Also each flight unit can be acceptance tested, so manufacturing will not require the strict process control necessary for solid motors. If a defect is discovered during the acceptance testing, in most cases the strut could be saved by simply reworking or replacing the defective parts. In addition, since the struts are inert until they are pressurized, ground handling hazards are eliminated, making handling a low-cost operation.

Parametric cost modeling bases the estimated cost on weight and similarities to selected components for which cost are available. Since the struts are half the weight of BDMs, they would be half the cost assuming equal complexity. This is the only level of cost analysis that is possible given the maturity of the MAG Strut design. Actual per-unit cost would need to be reevaluated after developed units have been fabricated and the design finalized.

MAG Strut Design

The MAG Strut struts are designed to take advantage of the increase in payload to orbit by separating at 356 kN residual first stage thrust. To achieve this, a significant force is required. Consequently, the struts can place a substantial bending moment into the edge of the aft skirt, increasing the potential for buckling during ascent. Also, sudden release of the energy stored in the struts could result in a significant jerk to the upper stage, which could affect propellant quality and tank pressure. The MAG Strut design is proposed in order to counter these effects. During ascent, only a low pressure acts against the upper stage aft skirt. At separation, the force applied increases gradually, which minimizes potential for skirt buckling and mitigates concerns about sloshing induced in the propellant tanks.

The MAG Struts are designed with two chambers as shown in FIG. 7. The low-pressure chamber 40 is meant to provide the initial force requirement for separation. In the example of FIG. 7 the metering rod 26 has an outside diameter of 7.62 cm, and the polished bore 24 has an inside diameter of 17.78 cm. The high pressure is 10,340 kPa and the low pressure is 1,034 kPa. The initial force calculation for each strut would be as follows:

$$\left\{\left[\frac{(7.62\,\mathrm{cm}^2)}{4}\right]*\pi\right\}*10{,}342\,kPa+\left\{\left[\frac{(17.78\,\mathrm{cm}^2-7.62\,\mathrm{cm}^2)}{4}\right]*\pi\right\}*1{,}034\ kPa=68{,}124\,N$$

Figure 8:
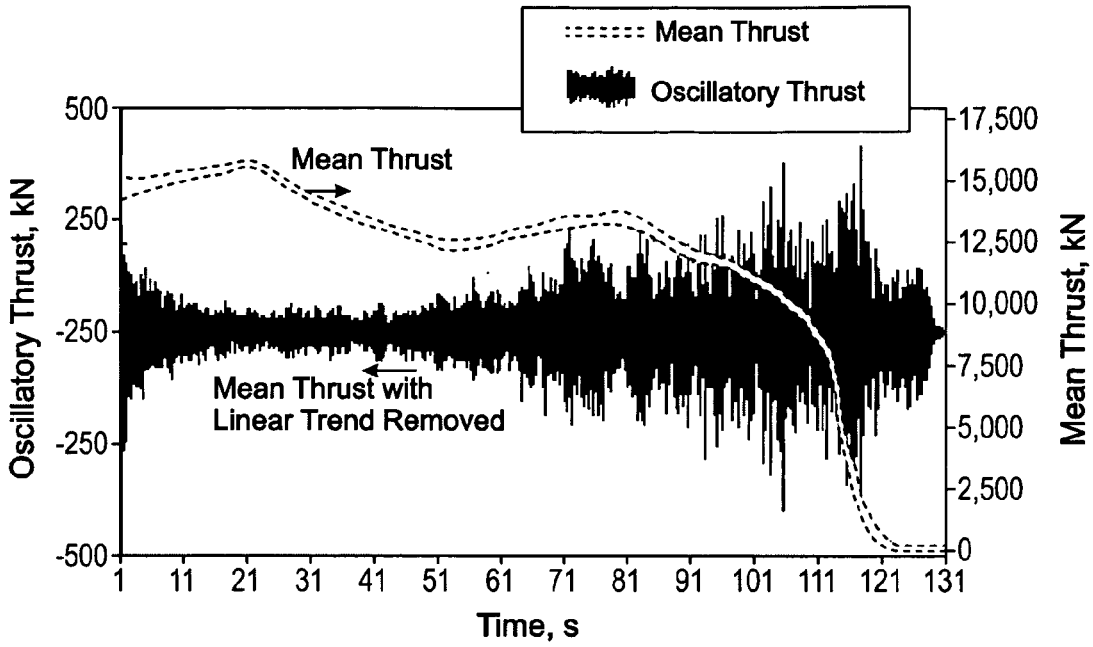
FIG. 8 is a graphic illustration plotting the transient oscillatory thrust of the Ares I first stage.

With 8 struts, the force of 545 kN is more than sufficient to overcome a SRM residual thrust of 356 kN thrust and the transient oscillatory force from the SRM, and therefore preventing re-contact of the two stages during separation. (See FIG. 8 for a plot of the transient oscillatory thrust of the Ares 1 first stage.) The high-pressure chamber 38 is intended to store the gas needed for the main part of the strut stroke. After 40 cm of stroke, this force reaches 1,495 kN. This force is capable of driving the first stage and upper stage apart with sufficient velocity margin to achieve separation with a residual first stage thrust of 356 kN.

Figure 9:
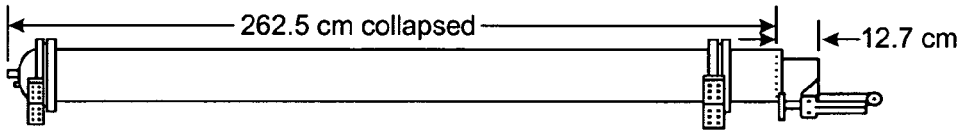
FIG. 9 is an exterior view of the gas strut of the present invention in a collapsed or first position.
Figure 10:
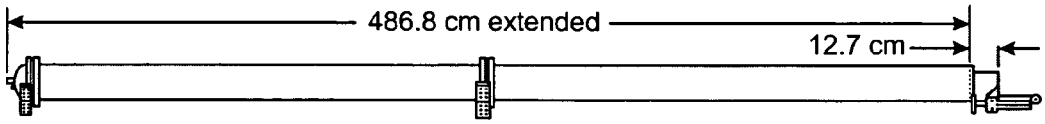
FIG. 10 is an exterior view of the gas strut in an extended or second position.
Figure 11:
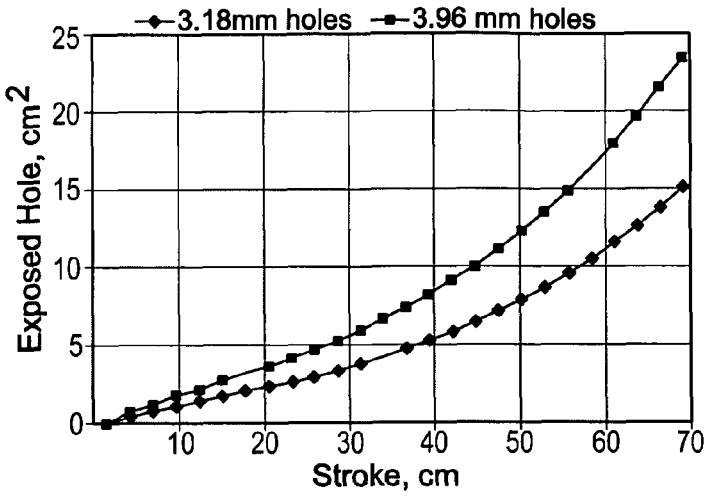
FIG. 11 is a graphic illustration showing the cumulative area for the exposed holes of the design of FIG. 7 as a function of stroke.

The metering rod 26 has a pattern of holes 42 that are exposed as the strut strokes, providing a gradual force buildup that will minimize impulse on the upper stage. FIG. 9 shows a computer-aided design (CAD) rendering of the strut in the collapsed position. FIG. 10 shows a CAD rendering of the strut in the extended position. Initially no holes are exposed. Once the strut has stroked 2.54 cm, 6 holes are exposed. FIG. 11 shows the cumulative area for the exposed holes as a function of stroke. Every 2.5 cm of additional stroke exposes more holes to achieve the gradual force build-up. (The summation of the total exposed hole-area for two different hole-sizes in shown at the bottom of the chart.) A large range of force profiles are possible with different hole-patterns. Holes larger than the "O" ring seal diameter would likely catch the seal, causing damage during stroking. A hole diameter of 3.96 mm would be the largest recommended hole size for a seal with a 4.83 mm diameter cross-section.

If the low pressure chamber 40 is allowed to be at ambient pressure by providing a very small hole to the exterior of the strut, the strut can operate with only one pre-pressurized volume. This variation would make it possible to charge only one chamber prior to launch, eliminating some potential failure modes. A strut with a 9.208 cm diameter metering rod and with no pressure in the small chamber would provide slightly more initial separation force than the strut 20 shown in FIG. 7 with 1,034 kPa gas in the low pressure chamber 40. This strut variant opens up the possibility of designing a hermetically sealed strut or other point design.

Figure 12:
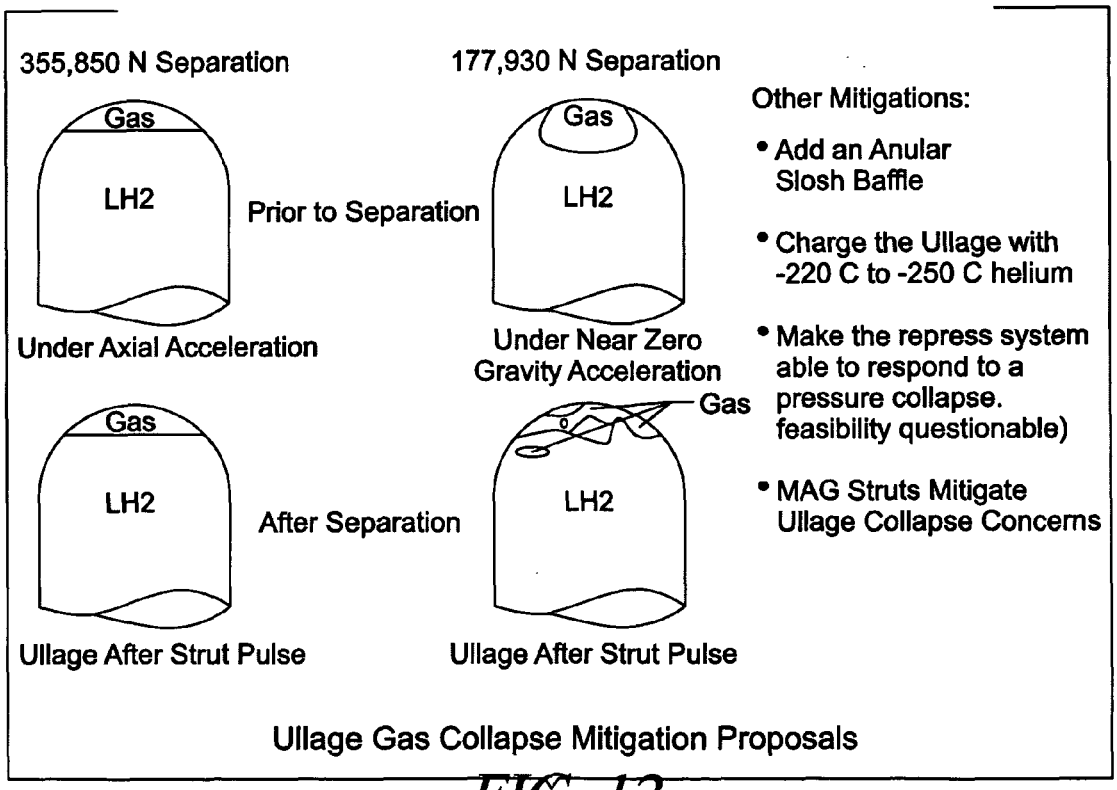
FIG. 12 is a schematic illustration of various ullage gas collapse mitigation proposals.

Since the desired thrust profile for the struts is based on requirements derived from a fluids analysis of the hydrogen tank pressure, having a strut capable of accommodating a range of force profiles is preferable. For a −147 degree C. initial ullage gas charge temperature, an acceleration rate of change of 2.5 g per second is acceptable. A higher axial rate of change may be acceptable with the currently proposed −220 to −250 degree C. pre-charge gas. Table 2 shows the predicted effect of lowering pre-charge gas temperature on the make-up gas required to recover from an ullage collapse. A change out of metering rods could adapt a set of struts to revised ullage requirements. Sloshing risk increases as the axial acceleration of the rocket diminishes. Surface tension and vibration force the fluid in the tank up the tank walls as shown in FIG. 12. Stage separation with 356 kN of residual thrust assures that the average axial acceleration never drops below 0.12 g. This is enough acceleration to force the ullage gas to remain in a hemispherical shape bubble. The MAG Strut system further mitigates the risk of ullage collapse by limiting the axial acceleration rate of change.

TABLE 2

Hydrogen Tank Recovery Gas Requirements
Initial tanked He assumptions: T = −250 C.; P = 22,00 kpa
Supply assumption: Isentropic Blowdown P = 6,895 kpa

| H2 pre-press temp | Mass for ullage recovery | Initial storage density (kg/m$^3$) | Final storage density (kg/m$^3$) | Delta density (kg/m$^3$) | Storage volume required | Bottle mass (kg) | Total loaded He mass (kg) | Total Mass (kg) |
|---|---|---|---|---|---|---|---|---|
| 19 C. | 226.9 kg | 192.38 | 144.81 | 47.58 | .486 m$^2$ | 1,390.0 | 917.2 | 3,642.2 |
| −181 C. | 115.7 kg | 192.38 | 144.81 | 47.58 | .248 m$^2$ | 708.6 | 467.5 | 1,176.5 |
| −220 C. | 0.0 | 192.38 | 144.81 | 47.58 | 0.00 | 0.0 | 0.0 | 0.0 |
| −250 C. | 0.0 | 192.38 | 144.81 | 47.58 | 0.00 | 0.0 | 0.0 | 0.0 |

Figure 13:
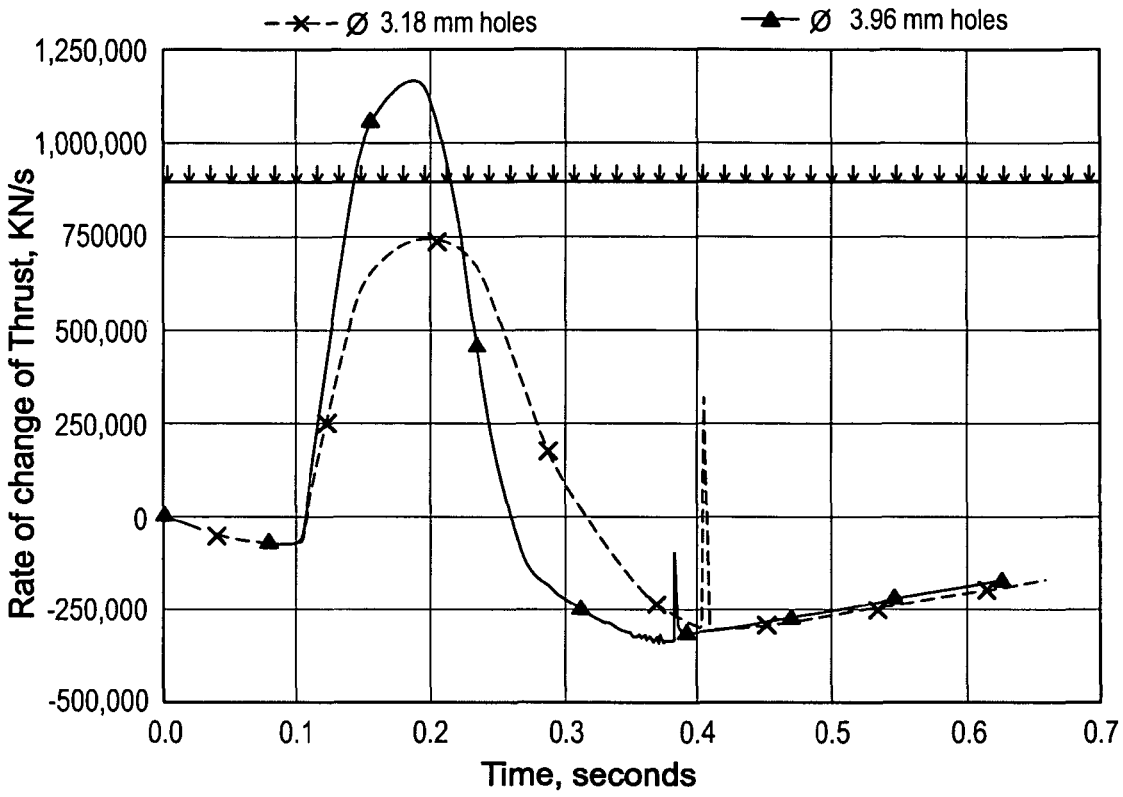
FIG. 13 is a graphic illustration of the calculated force rate of change for the gas strut of FIG. 7.

Real fluid analytical tools show that the smaller holes produce a force-profile that does not exceed 8,896.4 kN per second level as shown in FIG. 13. The force-profile has some irregularities that can be eliminated through further refinement of the hole-pattern. The force spike at 0.4 seconds indicates that a few more holes are needed in the last 7.62 cm of stoke for the 3.18 mm diameter holes. If the first row of holes were exposed after 1.27 cm of stroke rather than 2.54 cm of stroke, more energy could be recovered from the expanding gas. If a few less holes were exposed in the middle part of the metering rod, the rate of change peak could be lowered. For Ares I, the 3.18 mm diameter holes shown in this plot meet a 2.5 g/sec jerk requirement if the decay of the thrust of the SRB is considered.

Figure 14:
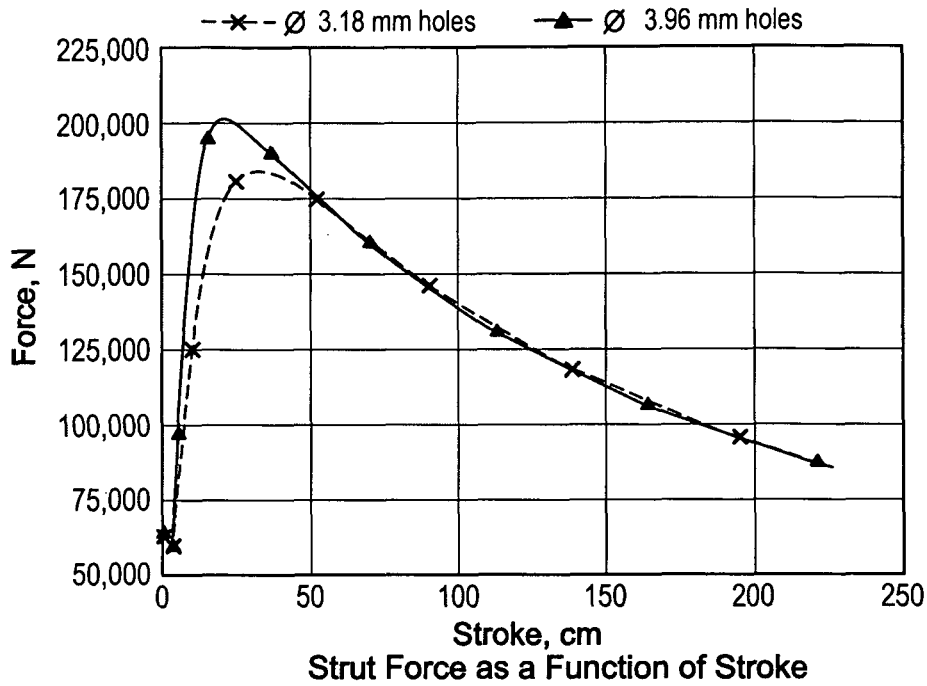
FIG. 14 is a graphic illustration of analytical results of the separating force as a function of stroke for the gas strut of FIG. 7.
Figure 15:
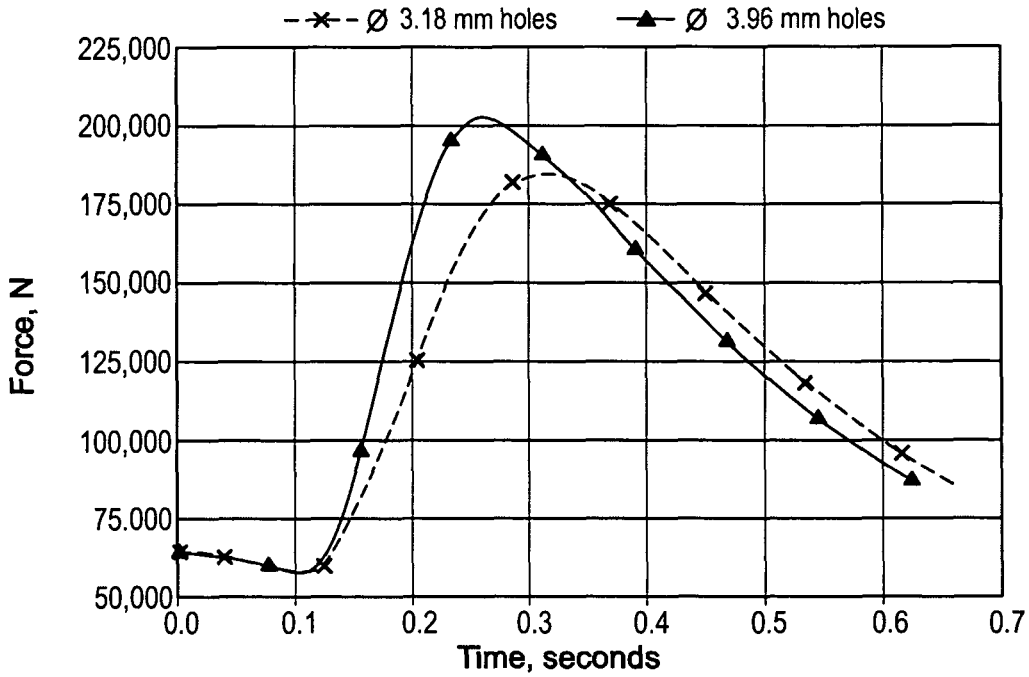
FIG. 15 is a graphic illustration of analytical results of the separating force as a function of time for the gas strut of FIG. 7.

FIG. 14 and FIG. 15 show the force profile analytical results for the same two hole-patterns as a function of stroke as well as a function of time respectively.

Development Program Goals and Objectives

Since gas struts have not been used for separation on a manned vehicle, development testing is needed to mitigate risk. The risk falls into three categories; performance related risk, reliability related risk, and programmatic risk. Programmatic risk is in some ways a sub-set of the stated technical risk because technical issues that arise in the strut development program could threaten the schedule for the launch of Ares I flight tests. This concern is one of the chief objections to this technology. A realistic approach to address this programmatic risk is to carry both BDMs and struts in the program until struts have demonstrated their capability. The struts are a bolt on technology, using the existing hole patterns on the upper part of the Ares I interstage attach ring and a direct bolt through on the upper stage aft skirt, so they can be installed with little impact on other systems. The recurring cost of the struts will not likely increase because of the development program. Because of development testing, the qualification program cost for a strut separation system will be substantially reduced. Programmatic-risks are addressed in this paper by eliminating technical risk through a robust development test program.

Resolving Performance Related Risk

Figure 16:
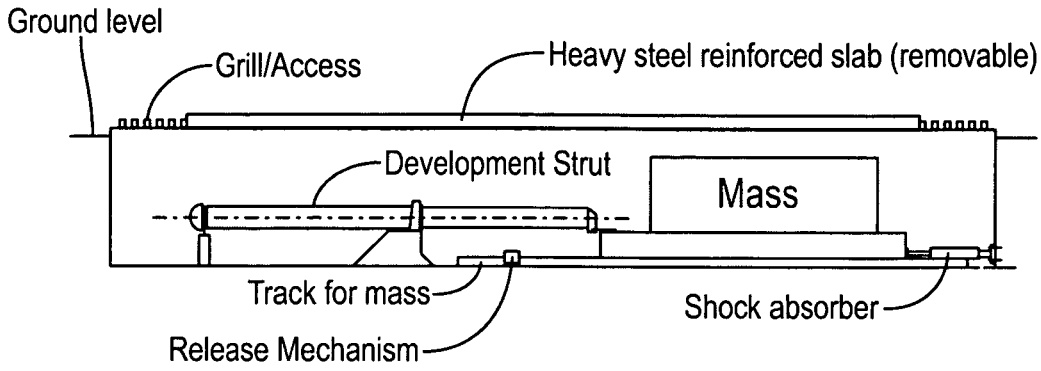
FIG. 16 is a schematic illustration of a strut performance development test setup.

The metering function of the MAG Strut system is determined by the size and pattern of holes along the metering rod 26. Development testing is required to characterize the strut performance with different metering rods under different conditions that simulate nominal operations and potential failures. Mathematical models provide solid indications of the flow rates for struts with various metering rods; however, their accuracy is not good enough to use for qualification by analysis. The development testing would provide data that would validate the analytical flow models. The best way to establish the force vs. distance performance characteristics of the struts is to test them with several different metering rods moving different masses. A range of pressures could also be investigated to establish the performance characteristics of the struts under nominal and degraded performance scenarios. A relatively simple test set-up as shown in FIG. 16 is required to perform the development testing. In this performance test, a mass of approximately 22,680 kg is released to be pushed by the strut. It will accelerate to approximately 6.17 meters per second and then disengage from the fitting mounted on the mass. After disengagement, the moving mass must be stopped by a snubber. Side forces acting against the fitting will be simulated by attaching a spring to the mass that applies a side force as it rolls down the track on its metal wheels. High-speed video recording will measure any twang or motion oscillations.

Figure 17:
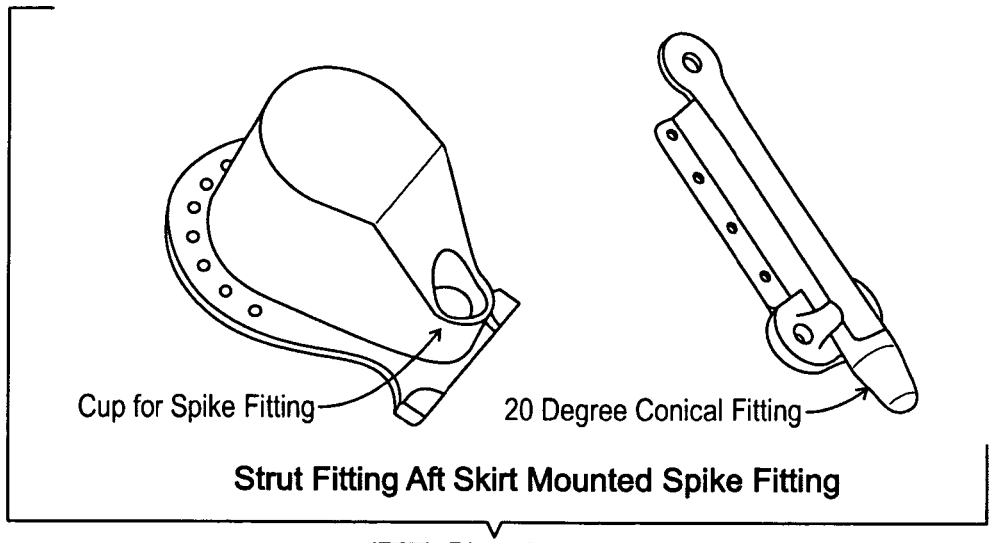
FIG. 17 shows a strut rod fitting and spike fitting for mounting to the upper stage.

The development program would seek to characterize the performance of the struts for several separate side force profiles that would represent a range of operational possibilities and off nominal load cases. The strut has Teflon slides on the piston and in the rod housing. If sufficient side force was present, a strut that was pressurized to less than 10% of the design pressure may bind at some point during the stroke of the strut. The mating conical interface of the rod fitting and the spike fitting on the upper stage is intended to gradually relieve side force as the struts disengage. If binding occurred on a partially charged strut, this side load relief action is intended to preclude disengagement of the strut from the fitting while pressurized. FIG. 17 shows the strut rod fitting and the spike fitting that is mounted to the upper stage. Because no failure scenario has been identified that indicates that binding is a problem, development testing will establish the amount of side loading required to cause the strut to bind such that the load relief action from the conical interfaces will not be adequate to relieve it.

Resolving Reliability Related Concerns

The safety of the struts must be demonstrated by test. The struts are designed to leak before burst; however, only testing can demonstrate this. If the leak before burst design is proven prior to qualification, the potential for a costly redesign and schedule slip is avoided. After completion of testing, one or more of the test struts would be subjected to extreme pressure until leakage or burst occurred. This burst test would be done with an oil or water charge to avoid the explosive hazards associated with gas.

Figure 18:
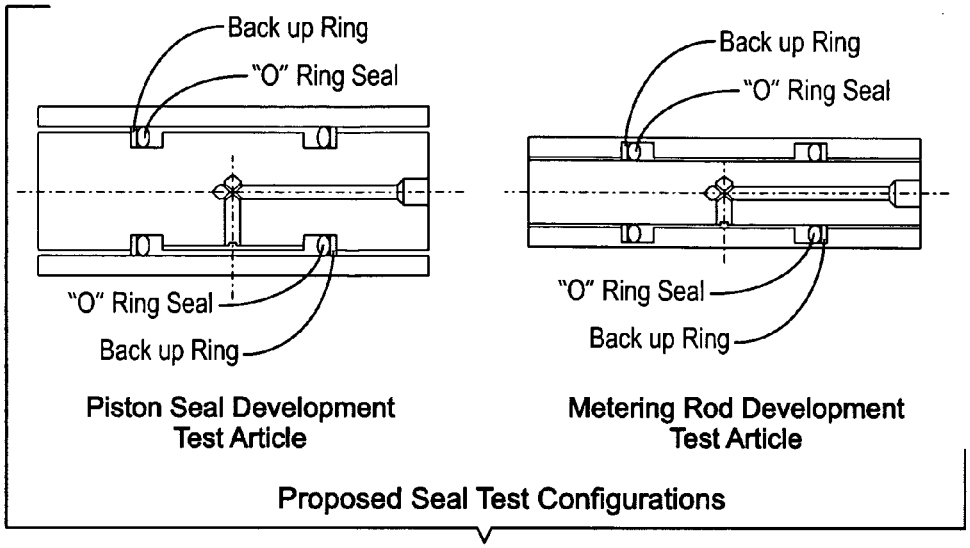
FIG. 18 shows proposed seal test configurations.

All elastomeric seals leak a minute amount of gas because of permeation of the seal material. The expected performance of each seal must be bounded in order to establish launch commit requirements and pad operations. Nominal leak rates of the seals could be established without assembly into the struts by using a test fixture as shown in FIG. 18. Different elastomer compounds could be evaluated for gas permeability at the pressures used in the strut. With this data the struts could be pressurized taking into account the number of days before launch. The low pressure chamber would gain a very small amount of pressure due to seal permeation during pad operations but not enough to exceed its required operating range.

Pressurizing the large volume chamber while leaving the low volume chamber at ambient pressure as discussed in the performance section of this paper would also be an option to eliminate uncertainties about rate of leakage into the low pressure chamber from the high pressure chamber. FIG. 18 shows potential test configurations for two different seals. Testing 50 seals of each type would provide a large enough sample size to characterize the nature of the seals under ambient conditions. Temperature extremes could also be evaluated by placing the small seal test fixture in a thermal chamber.

Analysis Needed Prior to System Testing

An analysis of the integrated system would be required to establish the overall capability of the MAG Strut system to achieve separation under all potential operational scenarios. Initial analysis shows startling results with large positive clearance margins for the nozzle during separation. Revisiting this analysis is required prior to system testing to assure that an undiscovered disturbance force acting in the system will not cause the results to degrade.

To recover the first stage, the interstage with the extended struts must be separated from the first stage. However, no analysis has been done to establish the clearance between the first stage and the interstage. The struts extend about 2.44 meters from the interstage. Consequently, their presence will make it more difficult to gain adequate clearance between the first stage and the interstage after separation of the interstage from the first stage.

Stress analysis of the second stage aft skirt interface with the spike fitting would provide a better understanding of the threat of buckling with a failed strut. If the high pressure seal fails on a strut, the good strut will apply 68 kN of load to the structure while the failed strut will apply 236 kN of load. The safety factor is 1 for analyzing a failure case. However, the safety factor is 1.65 for buckling without a failure. Showing sufficient margin under all conditions is required prior to approving a final design configuration.

A stress analysis using finite element models of the struts themselves is required to assure adequate margin exists for all components. This analysis would allow for weight optimization of the strut prior to finalizing the design.

Integrated System Testing

Figure 19:
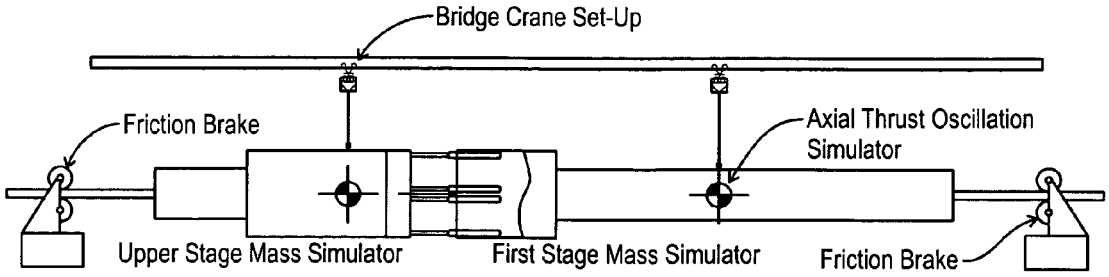
FIG. 19 shows a system demonstration test setup.

Testing the integrated system has the decisive advantage of establishing the validity of the analytical models used to evaluate separation dynamics. A close match between the development testing and the analytical models will make it possible to qualify the separation dynamics by analysis, avoiding an expensive flight test dedicated to qualifying the separation system. Actually simulating the flight conditions is not practical considering the cost and complexity of such a test set up. A test setup that is capable of simulating any flight condition in one plane could be used to demonstrate the system incrementally. FIG. 19 shows a proposed test setup that would be capable of simulating all of the most relevant conditions in the horizontal plane.

Different asymmetric strut cases could be combined with various simulated thrust conditions. The simulations could be accomplished by placing many support points at the center of gravity of each of the mass simulators. The brake rod would have a ball joint attachment at the center-of-gravity and the brake body would be free to rotate on a pivot arrangement. When the separation joint is activated, the brakes would simulate the effects of the SRB thrust and the relevant component of gravity acting on the vehicle. This set up would simulate the mass and the mass-moment-of-inertia of each of the stages. Thrust vector side loads would be simulated by springs acting between the rod coming from the brake and the end of the first stage. The brakes would also arrest the motion of the two bodies after separation was demonstrated. The axial thrust oscillation could be simulated by 2 large asymmetric counter-rotating masses near the center of gravity of the first stage. Demonstrating the ability to prevent re-contact after initial separation is a critical part of any separation qualification program. If the thrust oscillation was to slam the two stages back together after initial separation, impact loads would be transmitted to the sensitive avionics boxes on the aft skirt. Also, the structure of the aft skirt near the contact location could fail locally and unpredictable separation dynamics would be present.

MAG Strut Qualification

Qualifying the strut separation system will be a relatively quick, low cost program if a well-designed development test program is completed before hand. The separation dynamics will be qualified by analysis. The struts could be structurally qualified by analysis with the end fittings being considered qualified by test assuming that the qualification strut was pressurize with fluid that would generate sufficient force to subject the fitting to 1.4 times the limit load. Since the strut is designed with a safety factor of 2 for static pressure containments and a safety factor of 2.5 for dynamic pressure containment, the end fittings could be subjected to the limit loads without subjecting the struts to pressures that would yield the structure. The structure of the aft skirt and the interstage could be qualified by analysis. The development test would provide the data to validate the analytical models for both the struts and the structure. If some design changes were made to the flight struts that were not reflected in the development test articles, the qualification testing could be done using the same test set up used for development testing.

Conclusion

The MAG Struts are the ideal separation system for Ares I. No other separation system has the capability to separate with 356 kN of residual thrust on the first stage. This capability increases the Ares I payload lift capability significantly over a BDM separation system. Secondly, the MAG Strut system is mounted internally minimizing aerodynamic drag. Finally the MAG Strut system pushes the first stage and the second stage apart increasing the momentum transfer between the stages.

The struts reduce the potential for ullage collapse in two ways. Separating with 356 kN of residual thrust mitigates the potential for ullage collapse because the liquid hydrogen does not have the have the tendency to climb the walls of the tank as is possible when operating at very low levels of acceleration. The MAG Strut limits the amount of acceleration the vehicle experience to less than 2.5 g per second decreasing the potential to agitate the liquid hydrogen.

The MAG Strut limits the amount of load applied to the aft skirt during assent to 68 kN while they have the capability of stroking with a peak force 187 kN each.

The MAG Struts produce superior nozzle clearance under all conditions including one strut out cases. This means that the struts are inherently two-fault tolerant against pressure bleed down. The struts also greatly mitigate the effects of the SRB nozzle pointing accuracy and any other disturbances coming from another source because of the matching of the mass properties of the two separated stages.

Although struts have not been used on a manned vehicle, the struts can be brought up in design maturity in time to support later Ares I test launches assuming that the development test program is conducted concurrently with other Ares I development programs. Doing the development program facilitates the inclusion of the struts at a later date in the Ares program.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A method of providing a separating force, comprising:

(a) providing a gas strut including first and second telescoping members, a high pressure gas chamber, a low pressure gas chamber, a metering passage between the chambers, and a metering passage seal;

(b) holding the telescoping members in a telescopingly collapsed first position wherein the metering passage seal prevents gas flow through the metering passage, and providing a first separating force between the telescoping members in the first position due to gas pressure in the high pressure chamber;

(c) releasing the telescoping members and allowing the telescoping members to move from the first position toward a telescopingly expanded second position; and (d) as the telescoping members move from the first position toward the second position, flowing pressurized gas from the high pressure gas chamber to the low pressure gas chamber via the metering passage and increasing the separating force.

2. The method of claim 1, further comprising:

progressively increasing a cross-sectional area of the metering passage as the telescoping members move from the first position toward the second position.

3. The method of claim 2, wherein:

the progressively increasing step further comprises uncovering a series of metering ports of the metering passage.

4. The method of claim 2, wherein:

the progressively increasing step further comprises increasing a cross-sectional area of an annular metering port.

5. The method of claim 1, wherein:

gas pressure in the high pressure chamber acts upon a smaller differential area than does gas pressure in the low pressure chamber, so that the flow of gas from the high pressure chamber to the low pressure chamber results in an increased separating force between the first and second telescoping members.

6. The method of claim 1, wherein:

step (c) further comprises breaking a frangible connection.

* * * * *